US007614165B2

(12) United States Patent
Curry

(10) Patent No.: US 7,614,165 B2
(45) Date of Patent: Nov. 10, 2009

(54) INTERCHANGEABLE FOOTWEAR COMPONENT

(75) Inventor: David R. Curry, Chicago, IL (US)

(73) Assignee: Podi, L.L.C., Chicago, IL (US)

( * ) Notice: Subject to any disclaimer, the term of this patent is extended or adjusted under 35 U.S.C. 154(b) by 446 days.

(21) Appl. No.: 10/568,021

(22) PCT Filed: Apr. 22, 2005

(86) PCT No.: PCT/US2005/014005

§ 371 (c)(1),
(2), (4) Date: Feb. 10, 2006

(87) PCT Pub. No.: WO2005/104891

PCT Pub. Date: Nov. 10, 2005

(65) Prior Publication Data

US 2008/0086914 A1 Apr. 17, 2008

Related U.S. Application Data

(60) Provisional application No. 60/565,067, filed on Apr. 23, 2004.

(51) Int. Cl.
*A43B 3/24* (2006.01)

(52) U.S. Cl. ..... 36/101

(58) Field of Classification Search ..... 36/101, 36/100, 15

See application file for complete search history.

(56) References Cited

U.S. PATENT DOCUMENTS 2,200,080 A 5/1940 Fein
2,302,596 A * 11/1942 Bigio ..... 36/101
2,809,449 A 10/1957 Smith
2,934,838 A 5/1960 Ferreira
3,601,909 A 8/1971 Amendola
3,972,136 A 8/1976 Epstein
3,994,080 A 11/1976 Flanagan, Jr. et al.
4,103,440 A 8/1978 Lawrence
4,267,650 A 5/1981 Bauer
4,270,285 A 6/1981 Antonious
4,275,513 A 6/1981 Antonious
4,281,466 A 8/1981 Malone (Continued)

FOREIGN PATENT DOCUMENTS

FR 2659837 A1 9/1991

(Continued)

OTHER PUBLICATIONS

International Search Report by the United States Searching Authority in parent application PCT/US05/14005, dated Aug. 3, 2005.

*Primary Examiner*—Ted Kavanaugh
(74) *Attorney, Agent, or Firm*—McDonnell Boehnen Hulbert & Berghoff LLP

(57) ABSTRACT

Embodiments provide for an easily interchangeable footwear component, such as an upper portion of an article of footwear. In one embodiment, an article of footwear can comprise a fixed upper portion of an article of footwear, a sole fixedly connected to the fixed upper portion, and an interchangeable upper portion. Both the sole and the interchangeable upper portion can include one or more releasable fasteners, which allow the interchangeable upper portion to be releasably fastened to the article of footwear.

29 Claims, 10 Drawing Sheets

U.S. PATENT DOCUMENTS

| | | | | | |
|---|---|---|---|---|---|
| 4,296,559 | A | | 10/1981 | Gamm | |
| 4,333,248 | A | | 6/1982 | Samuels | |
| 4,372,060 | A | | 2/1983 | Adamik | |
| 4,377,042 | A | | 3/1983 | Bauer | |
| 4,384,414 | A | | 5/1983 | Gamm | |
| 4,577,418 | A | | 3/1986 | Nagy | |
| 4,584,783 | A | | 4/1986 | Dobbin | |
| 4,612,714 | A | | 9/1986 | Gamm | |
| 4,630,383 | A | | 12/1986 | Gamm | |
| 4,638,579 | A | | 1/1987 | Gamm | |
| 4,697,363 | A | | 10/1987 | Gamm | |
| 4,726,128 | A | | 2/1988 | Lin | |
| 4,745,693 | A | | 5/1988 | Brown | |
| 4,907,352 | A | | 3/1990 | Ginsberg | |
| 4,958,447 | A | | 9/1990 | DuPree | |
| 4,974,344 | A | | 12/1990 | Ching | |
| 5,065,531 | A | | 11/1991 | Prestridge | |
| 5,083,385 | A | | 1/1992 | Halford | |
| 5,109,614 | A | | 5/1992 | Curry | |
| 5,144,759 | A | * | 9/1992 | Mascotte | 36/7.1 R |
| 5,311,676 | A | | 5/1994 | Hughes et al. | |
| 5,317,822 | A | | 6/1994 | Johnson | |
| 5,406,722 | A | | 4/1995 | Jones | |
| 5,505,011 | A | * | 4/1996 | Bleimhofer | 36/4 |
| 5,544,430 | A | | 8/1996 | Jacko | |
| 5,551,172 | A | | 9/1996 | Yu | |
| 5,566,477 | A | | 10/1996 | Mathis et al. | |
| 5,600,901 | A | | 2/1997 | Leonor | |
| 5,642,573 | A | | 7/1997 | Brown | |
| 5,727,334 | A | | 3/1998 | Cougar | |
| 5,740,559 | A | | 4/1998 | Thiel | |
| 5,778,564 | A | * | 7/1998 | Kettner | 36/101 |
| 5,921,008 | A | | 7/1999 | Ruff | |
| 5,983,528 | A | | 11/1999 | Hartung | |
| 6,212,797 | B1 | | 4/2001 | Merry et al. | |
| 6,477,788 | B1 | | 11/2002 | Chen | |
| 2002/0029494 | A1 | | 3/2002 | Small | |
| 2002/0066208 | A1 | | 6/2002 | Hall | |
| 2002/0088144 | A1 | | 7/2002 | Katz et al. | |
| 2002/0184795 | A1 | | 12/2002 | Kan | |
| 2002/0194750 | A1 | | 12/2002 | Feick | |
| 2003/0088996 | A1 | | 5/2003 | Hall | |
| 2003/0177664 | A1 | | 9/2003 | Monassebian | |
| 2004/0093764 | A1 | | 5/2004 | Cheng | |
| 2004/0128862 | A1 | | 7/2004 | Flack | |
| 2004/0143998 | A1 | | 7/2004 | Yang | |
| 2004/0187346 | A1 | | 9/2004 | Bianchi et al. | |
| 2004/0194349 | A1 | | 10/2004 | Delgatty | |
| 2004/0231197 | A1 | | 11/2004 | Yama | |
| 2005/0016026 | A1 | | 1/2005 | Long | |
| 2005/0034332 | A1 | | 2/2005 | Moschel et al. | |

FOREIGN PATENT DOCUMENTS

| | | | |
|---|---|---|---|
| WO | WO 03/000082 | A1 | 1/2003 |
| WO | 03/075696 | A1 | 9/2003 |

* cited by examiner

INTERCHANGEABLE FOOTWEAR COMPONENT

CROSS REFERENCE

This application claims priority to U.S. Provisional Patent Application Ser. No. 60/565,067 filed on Apr. 23, 2004.

FIELD OF THE INVENTION

The present invention relates to footwear and footwear accessories, and, more particularly, to interchangeable footwear components, such as interchangeable uppers, for example.

BACKGROUND

Fashion, and the desire to be fashionable, is becoming more and more important in today's society. Fashion is also becoming more and more fast-paced—it seems to change all the time, and is even cyclical. Yesterday's fashion often becomes tomorrow's new thing. Although keeping up with the latest trends can be fun, fashion can also be expensive, especially when it changes quickly. One day's styles or colors could be passe the following week, and the clothes or footwear bought with one day's "in" colors may never be worn again once those styles or colors are "out," despite the clothes or footwear being perfectly functional, wearable, or, in short, almost like new.

Are ever-changing fashions any wonder, however, considering that people's tastes, and needs, also change just as frequently? For instance, one day someone's favorite color might be blue, but another day that same person's favorite color might be red. One day someone might need brown shoes to match a brown belt, while another day that same person might need black shoes to match a black belt. Or a particular color seen at a store under certain lighting may not appear the same at home. Likewise, the available colors of goods purchased over the Internet, or through a catalog, etc., may not accurately reproduce on a computer screen or on a catalog page.

Even as fashions and tastes change, the quality of footwear, clothes, and other garment-related goods and accessories increases. The technology exists for clothes to last longer—shirts are being made out of expensive, high-tech fabrics, in part, to improve wearability. Likewise, the quality of footwear is increasing. For example, soles can be constructed out of materials vastly superior to those used in the past, and as a result can last longer and be more durable.

It therefore becomes clear that in many instances, and for many different reasons, purchasers of footwear, clothes, and other garment related goods and accessories may want change. For example, a purchaser of footwear might want to change the color of the footwear, for instance, to match his or her clothes, accessories, etc.; to keep up with fashion; or just because the wearer prefers one color over another. Likewise, a purchaser of footwear might want to change worn out components of the footwear, such as the uppers, for example. Importantly, a purchaser of footwear might just change components of the footwear to have fun.

Thus, a need exists for a product that allows footwear components to be easily changed.

SUMMARY

According to one embodiment, an interchangeable upper portion of an article of footwear can comprise one or more releasable fasteners for releasably fastening the interchangeable upper portion to an article of footwear; and one or more alignment means for aligning the interchangeable upper portion on an article of footwear prior to releasably fastening the interchangeable upper portion to an article of footwear.

According to another embodiment, an article of footwear can comprise an upper portion; a sole fixedly connected to the upper portion; and one or more releasable fasteners for releasably fastening an interchangeable upper portion to the article of footwear.

According to another embodiment, an article of footwear can comprise a fixed upper portion of an article of footwear; a sole fixedly connected to the fixed upper portion; and one or more releasable fasteners releasably fastening an interchangeable upper portion of an article of footwear to the article of footwear.

According to another embodiment, a method of releasably fastening an interchangeable upper portion of an article of footwear to a fixed upper portion of an article of footwear can comprise engaging one or more alignment means on the interchangeable upper portion with one or more alignment means on the article of footwear; and releasably fastening the interchangeable upper portion to the fixed upper portion.

A variety of alternatives will become apparent to those skilled in the art upon review of the following detailed description.

BRIEF DESCRIPTION OF THE DRAWINGS

Exemplary embodiments are described herein with reference to the drawings, in which.

DETAILED DESCRIPTION OF EXEMPLARY EMBODIMENTS

1. Exemplary Embodiments

This application is directed to interchangeable uppers for use with footwear. Advantageously, a user can easily interchange uppers from an article of footwear, such as a shoe (for example, a running shoe, cross-training shoe, hiking shoe, clog, bowling shoe, walking shoe, golf shoe, soccer shoe, or dress shoe), boot, skate, sandal, etc. This interchangeable upper can enable a user to replace, cover, uncover, and/or recover the upper or a portion of the upper on a single article of footwear, so that it can take on various looks, styles, materials, and/or functions, or so that worn out uppers can be replaced.

Figure 1:
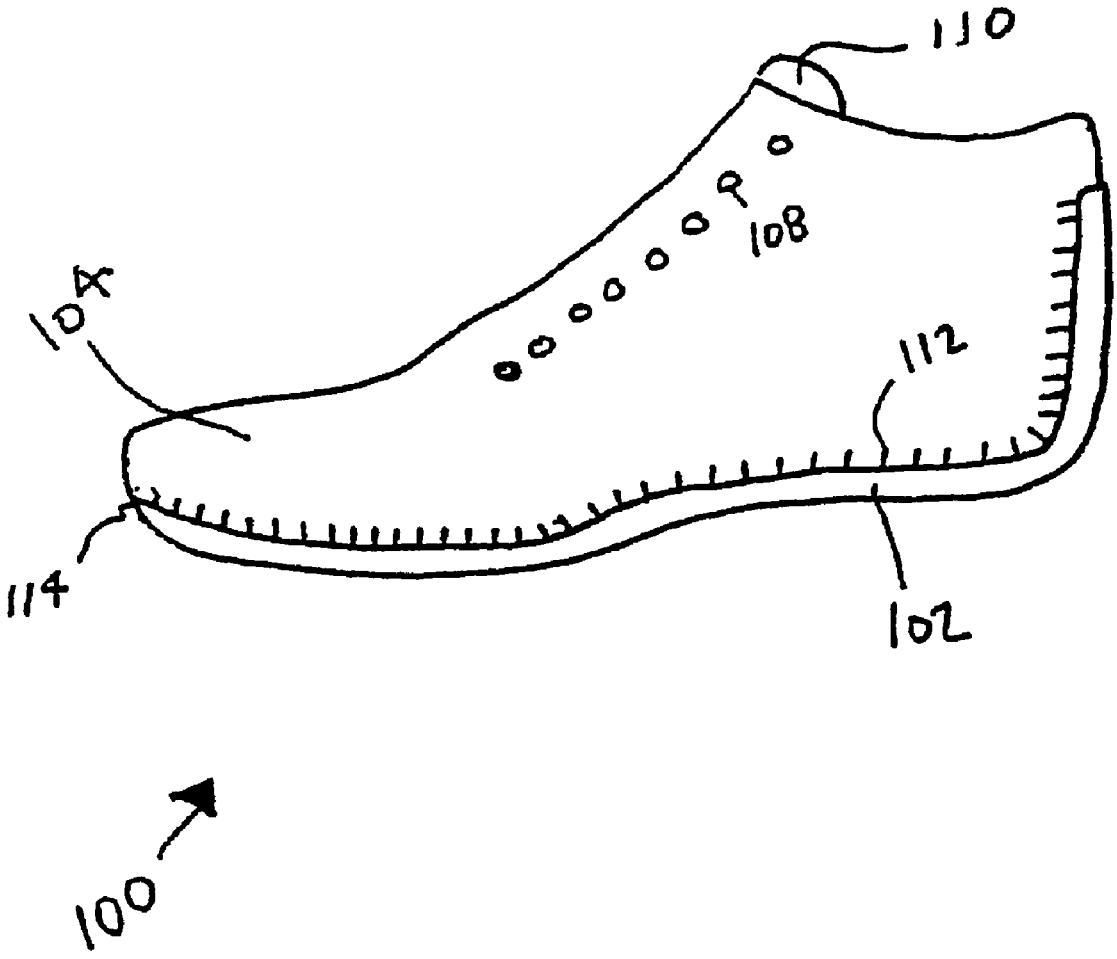
FIG. 1 depicts a side view of an article of footwear in accordance with an exemplary embodiment.

Referring to the drawings, FIG. 1 is a side view of an article of footwear 100 in accordance with an exemplary embodiment. As illustrated in FIG. 1, the article of footwear 100 may include a sole 102 and a fixed upper 104 fixedly connected to the sole 102. In one embodiment, the fixed upper 104 is a bootie type of inner sock and is configured to receive and support an interchangeable upper 200 (shown in FIG. 2), thereby forming the article of footwear 100 shown in FIG. 4. Moreover, the fixed upper 104 may be fixedly connected to the sole 102 through any of a number of arrangements; for example, the fixed upper 104 can be directly attached to the sole 102 on the outside or the on the inside surface of the sole 102, the fixed upper 104 can be indirectly attached to the sole 102 via another component of the article of footwear 100, etc.

The fixed upper 104 can comprise components of the article of footwear 100 that are not included on the interchangeable upper. Thus in one embodiment, the fixed upper 104 may include eyelets 108 for use in combination with shoelaces for securing the article of footwear 100 to a user's foot. Other and/or additional methods or devices for securing the article of footwear 100 to the user's foot are also possible. Additionally, the fixed upper 104 may include a tongue 110 for protecting the user's foot from the area where the eyelets 108 and shoelaces, for instance, secure the article of footwear 100 to the user's foot. The sole 102 shown in FIG. 1 can extend from the bottom of the article of footwear 100 toward the top of the article of footwear 100 in the heel area; however, other sole 102 configurations are also possible.

The article of footwear 100 can also include a first and second footwear releasable fasteners 112 and 116 (shown in FIG. 5A) for securing an interchangeable upper 200 (shown in FIG. 2) to each side of the article of footwear 100. In one embodiment, the first and second footwear releasable fasteners 112 and 116 are zippers. Alternatively, fewer (such as only one releasable fastener), additional, and/or other types of releasable fasteners, such as snaps or hook and loop fasteners, such as Velcro™ fasteners, can be used. As shown in FIG. 1, the first and second footwear releasable fasteners 112 and 116 can each start at the toe of the article of footwear 100 and extend along the length of each respective side toward the heel of the article of footwear 100. Additionally, the first and second footwear releasable fasteners 112 and 116 may extend from the bottom surface of the article of footwear 100 in an upward direction as they near the heel. In one embodiment, this configuration might allow for easier manufacturing and assembly, and might better secure an interchangeable upper 200 to the article of footwear 100.

Figure 5A:
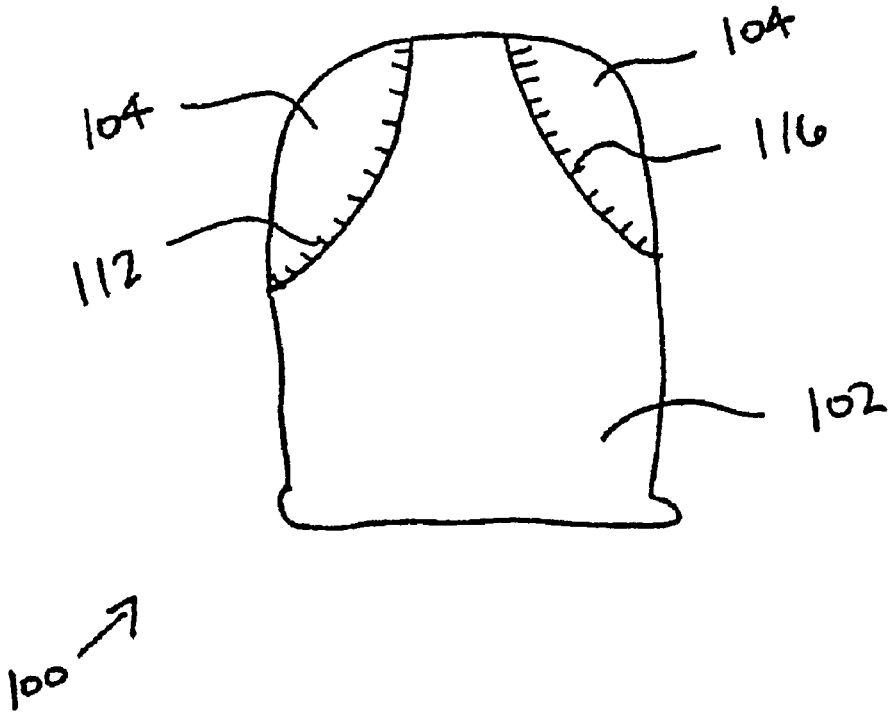
FIG. 5A depicts a rear view of the article of footwear in accordance with an exemplary embodiment.

The first and second footwear releasable fasteners 112 and 116 shown in FIGS. 1 and 5A are attached to the sole 102 of the article of footwear 100 near the interface between the fixed upper 104 and the sole 102. However, the first and second footwear releasable fasteners 112 and 116 can also be attached to the fixed upper 104, both the sole 102 and the fixed upper 104, and/or a combination thereof at various points along the length of the article of footwear 100. Additionally, each of the first and second footwear releasable fasteners 112 and 116 may be attached to the article of footwear 100 at different points and in different configurations.

As shown in FIG. 1, a footwear alignment means 114 might be located near the toe of the article of footwear 100, and can be used to align and/or help secure the interchangeable upper 200 (shown in FIG. 2) to the article of footwear 100. For example, the footwear alignment means 114 might align the interchangeable upper 200 with the article of footwear 100 to facilitate the first and second footwear releasable fasteners 112 and 116 engaging the interchangeable upper 200.

In one embodiment, the footwear alignment means 114 might comprise a hook or projection on the article of footwear 100 that can engage the interchangeable upper 200 (shown in FIG. 2), for example, at an opening or aperture on the interchangeable upper 200. Alternatively, additional and/or other types of footwear alignment means 114, such as a snap or hook and loop fasteners, such as Velcro™ fasteners, for example, could be used. The footwear alignment means 114 could be attached to the article of footwear 100 at the fixed upper 104, the sole 102, or a combination of the fixed upper 104 and the sole 102. The footwear alignment means 114 could be used only in areas where the interchangeable upper is not fastened to the article of footwear 100, as well as in areas that are fastened to the article of footwear 100 via the first and second footwear releasable fasteners 112 and 116, for instance.

Figure 2:
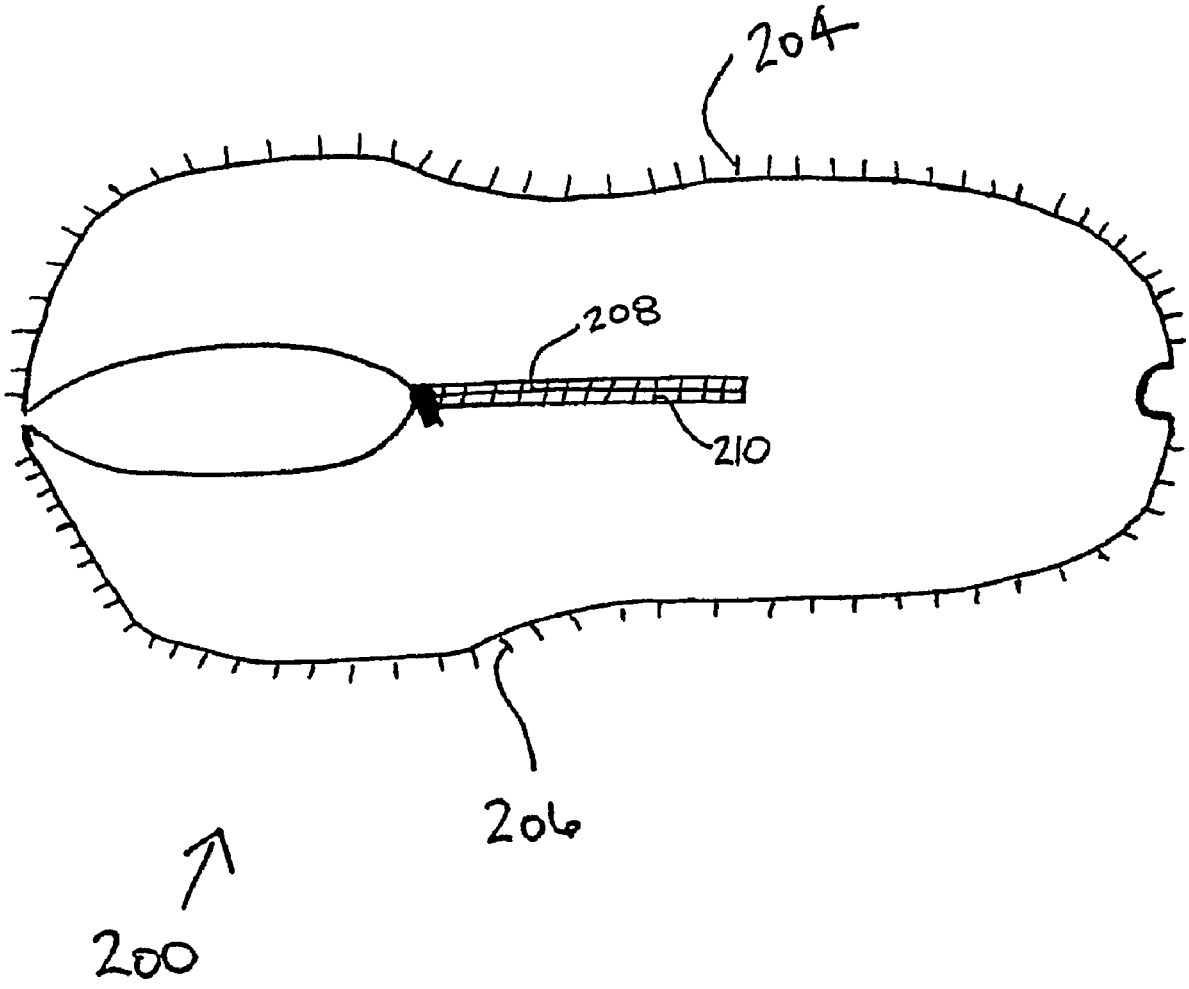
FIG. 2 depicts a top view of an interchangeable upper in accordance with an exemplary embodiment, shown in a flattened state.

FIG. 2 is a top view of an interchangeable upper 200, with the heel portion of the upper shown on the left and the toe portion of the upper shown on the right. In one embodiment, the interchangeable upper 200 can cover at least a portion of the article of footwear 100. In other embodiments, the interchangeable upper 200 can comprise at least a portion of an upper of an article of footwear. That is, the interchangeable upper 200 can comprise the upper or a portion of the upper itself, and not just a cover for the upper. Other examples are possible as well.

The interchangeable upper 200 of FIG. 2 is shown in a flattened state. The interchangeable upper 200 may be arranged to cover at least a portion of the fixed upper 104 and/or sole 102, and can comprise a first and second upper releasable fasteners 204 and 206 for releasably fastening the interchangeable upper 200 to the article of footwear 100. In one embodiment, the first and second upper releasable fasteners 204 and 206 can be zippers, and can zip onto and off of the corresponding first and second footwear releasable fasteners 112 and 116, to secure the interchangeable upper 200 to and remove the interchangeable upper 200 from the article of footwear 100.

The interchangeable upper 200 can be sized and shaped to cover specific portions of the article of footwear 100. A particular interchangeable upper 200 could, for instance, be sized and shaped to cover the entire front and sides of an article of footwear 100 of a particular size, or range of sizes. Additionally, the interchangeable upper 200 could be fabricated from many different types of materials, including cloth, neoprene, nylon, leather, or rubber. Other types of materials are also possible. In an alternative embodiment the interchangeable upper 200 may also be reversible to allow the user to use both sides of a single interchangeable upper 200.

The interchangeable upper 200 may also include an opening 208 to provide a user with access to the shoelaces, or other footwear securing devices, without having to detach the interchangeable upper 200 from the article of footwear 100. The opening may be closeable using an additional fastener 210, such as a zipper, as shown in FIG. 2. Other types of fasteners, such as snaps or hook and loop fasteners, such as Velcro™ fasteners, are possible as well. The opening 210 is shown in a closed position in FIG. 2.

Figure 3:
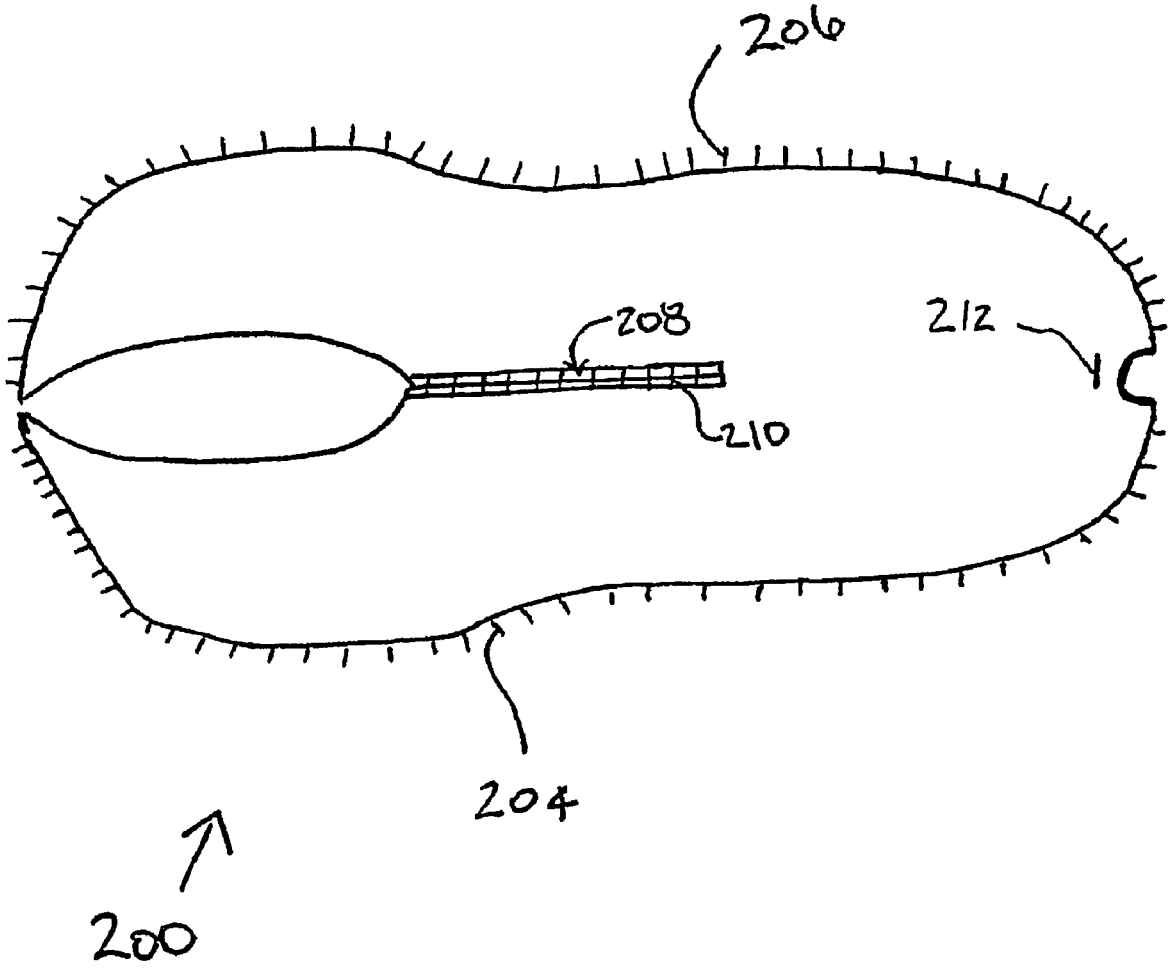
FIG. 3 depicts a bottom view of the interchangeable upper in accordance with an exemplary embodiment, shown in a flattened state.

FIG. 3 is a bottom view of the interchangeable upper 200 of FIG. 2, with the heel portion of the upper shown on the left and the toe portion of the upper shown on the right. As shown in FIG. 3, the interchangeable upper 200 can also include an upper alignment means 212, which might be an aperture or indentation for aligning and/or securing the interchangeable upper 200 to the article of footwear 100. The upper alignment means 212 may be configured to engage the footwear alignment means 114 of the article of footwear 100 to align and/or help secure the interchangeable upper 200 with the article of footwear 100. Other alignment devices and methods are possible as well.

Figure 4:
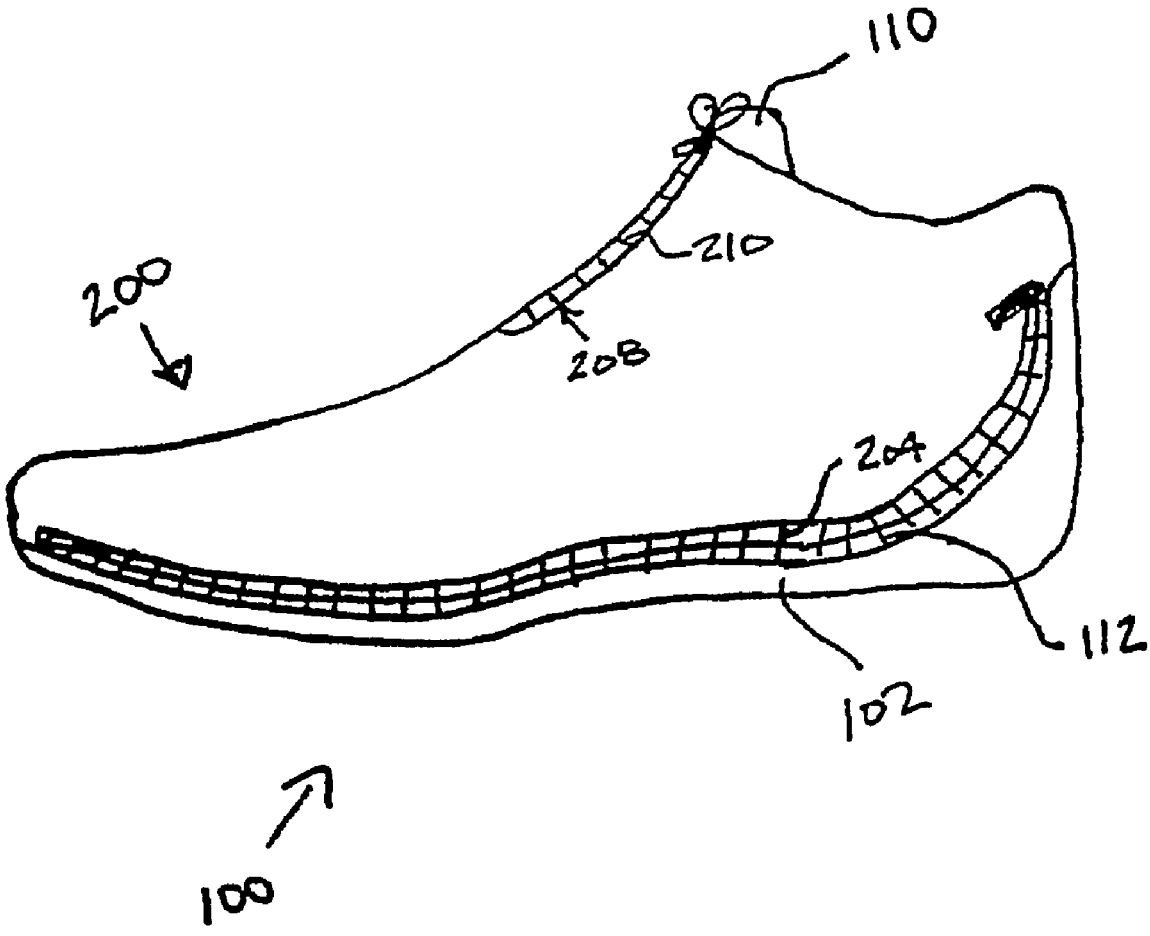
FIG. 4 depicts a side view of the article of footwear with the interchangeable upper attached, in accordance with an exemplary embodiment.

FIG. 4 is a side view of the article of footwear 100, showing the interchangeable upper 200 attached to the article of footwear 100. As shown in FIG. 4, the interchangeable upper 200 is sized and shaped in such a way as to cover at least a portion of the article of footwear 100. Additionally, the first footwear releasable fastener 112 is shown fastened to the first upper releasable fastener 204, thereby securing the interchangeable upper 200 to the article of footwear 100. As depicted in the configuration of FIG. 4, the footwear alignment means 114 (not shown) can also engage the upper alignment means 212 (not shown), to align and/or further secure the interchangeable upper 200 to the article of footwear 100.

Figure 5B:
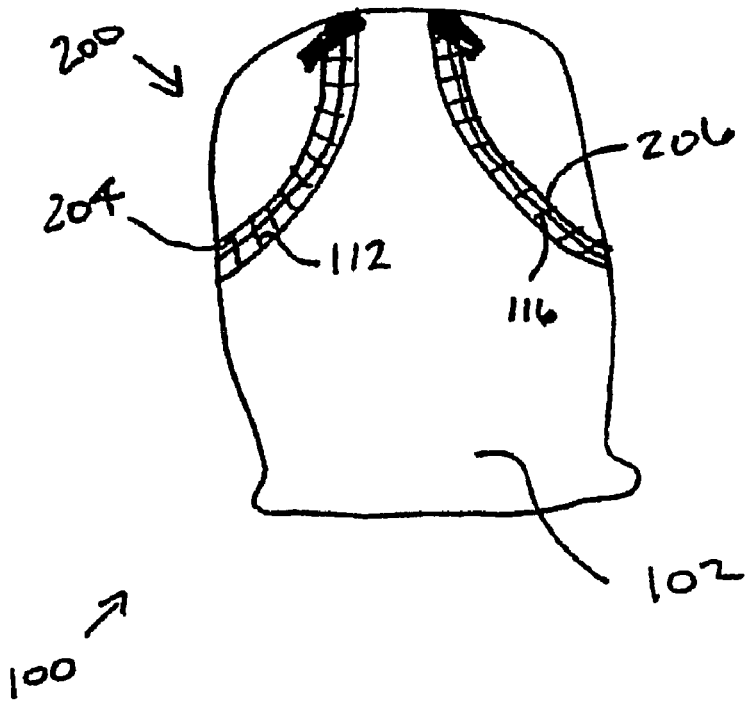
FIG. 5B depicts a rear view of the article of footwear with the interchangeable upper attached, in accordance with an exemplary embodiment.

FIG. 5A is a rear view of the article of footwear 100 of FIG. 1. As shown in FIG. 5A, the first and second footwear releasable fasteners 112 and 116 can curve toward an upward direction as they near the back of the article of footwear 100. FIG. 5B is a rear view of the article of footwear 100 of FIG. 4, showing the interchangeable upper 200 attached to the article of footwear 100.

Figure 6:
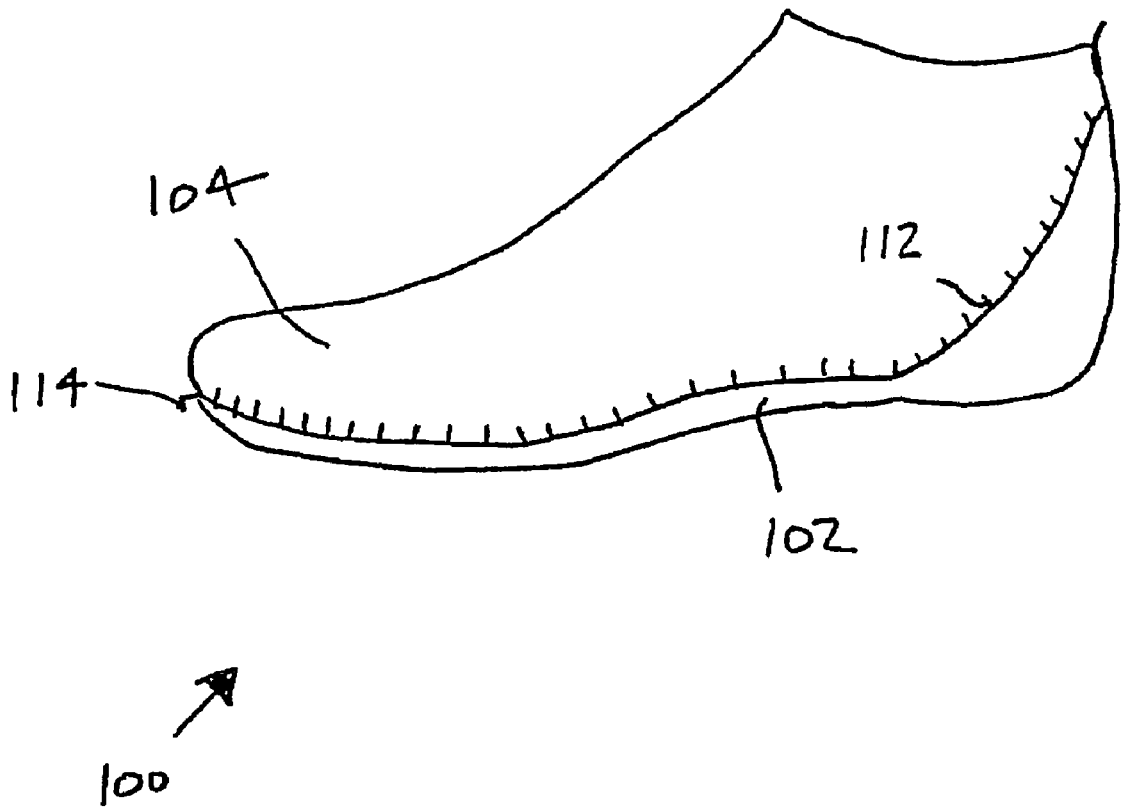
FIG. 6 depicts a side view of an article of footwear in accordance with an exemplary embodiment.

FIG. 6 is a side view of another embodiment of the article of footwear 100. Like the article of footwear 100 shown in FIG. 1, the article of footwear 100 illustrated in FIG. 6 may include a sole 102 and a fixed upper 104 fixedly attached to the sole 102. The embodiment shown in FIG. 6, however, does not include eyelets in the fixed upper 104 for shoelaces.

In one embodiment, the article of footwear 100 can be slipped onto and off a user's foot without manipulating a fastening device. In other embodiments, a fixed upper 104 without eyelets might have a zipper along a side of the fixed upper 104 or a drawstring around the opening of the fixed upper 104 to secure the article of footwear 100 to a foot, or to facilitate the insertion or removal of a foot into or from the article of footwear. Other examples are possible as well. In one embodiment, the fixed upper 104 might be fabricated from an elastic material to aid in securing the footwear 100 to a user's foot by elastically engaging the foot. Alternatively, an elastic material might be attached to the fixed upper 104 near the opening in the upper for the user's foot to aid in securing the footwear 100 to the user's foot. Other and/or additional methods or devices for securing the article of footwear 100 to the user's foot, or for facilitating the insertion or removal of a foot into or from the article of footwear 100, are also possible.

Figure 7:
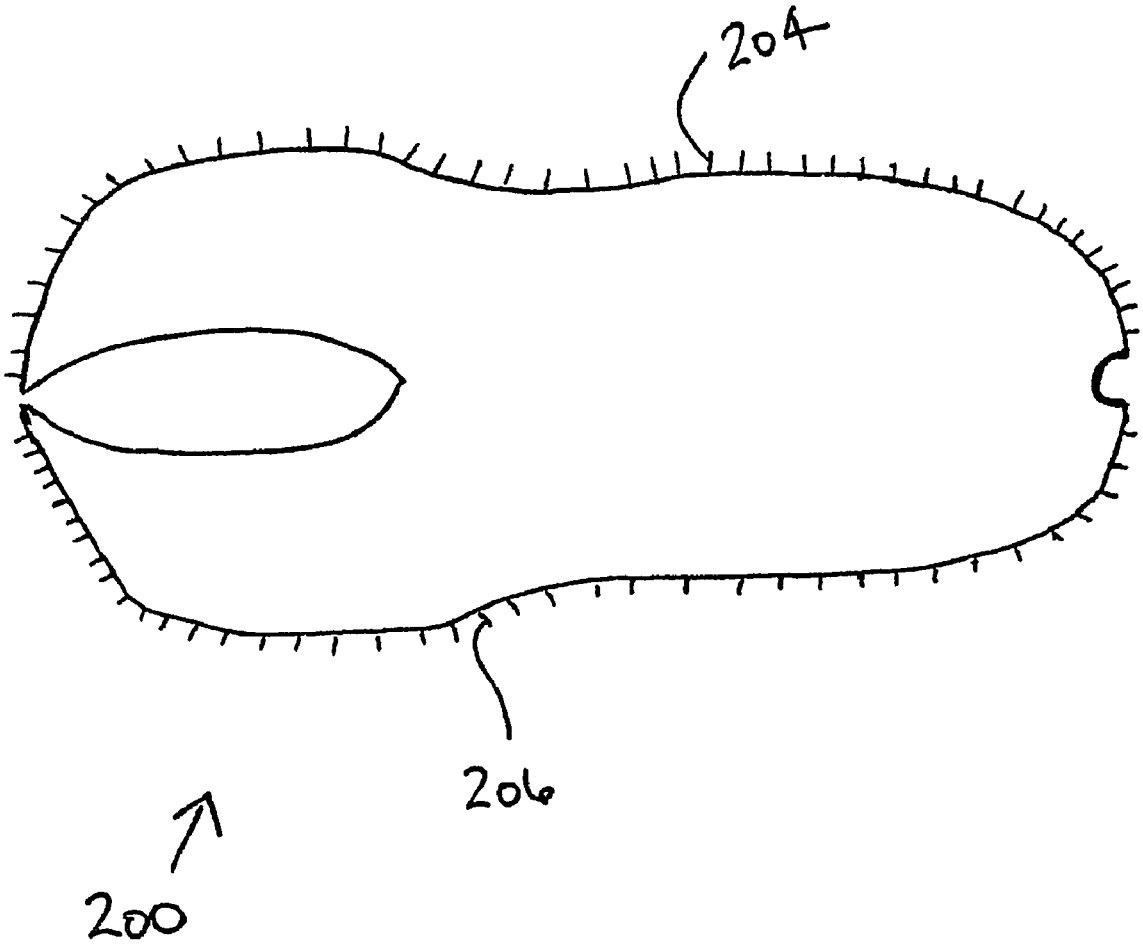
FIG. 7 depicts a top view of an interchangeable upper in accordance with an exemplary embodiment, shown in a flattened state.

FIG. 7 is a top view of an alternate embodiment of the interchangeable upper 200. As depicted in FIG. 7, the interchangeable upper 200 might not include an opening to provide a user with access to the shoelaces, or other footwear securing devices. The interchangeable upper depicted in FIG. 7 can engage the article of footwear 100 depicted in FIG. 6 using methods and devices described herein, for example, including by use of the alignment means 114 (not shown).

Figure 8:
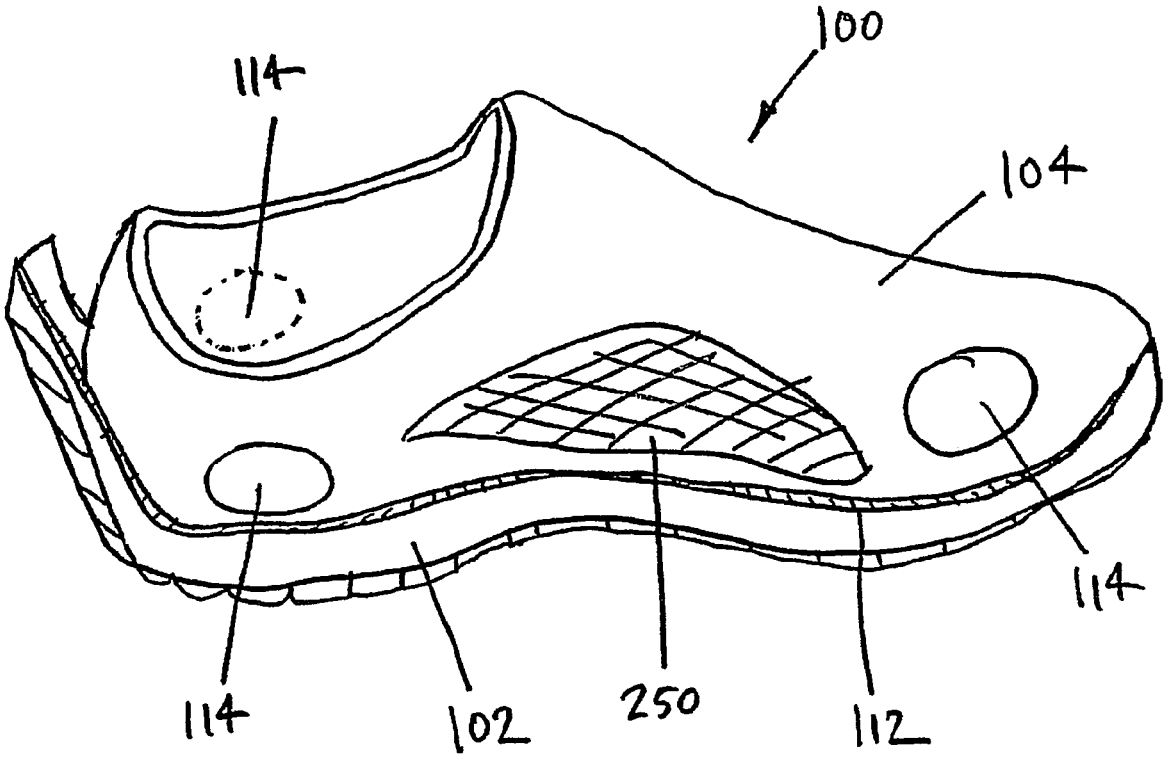
FIG. 8 depicts a side view of an article of footwear in accordance with an exemplary embodiment.
Figure 9:
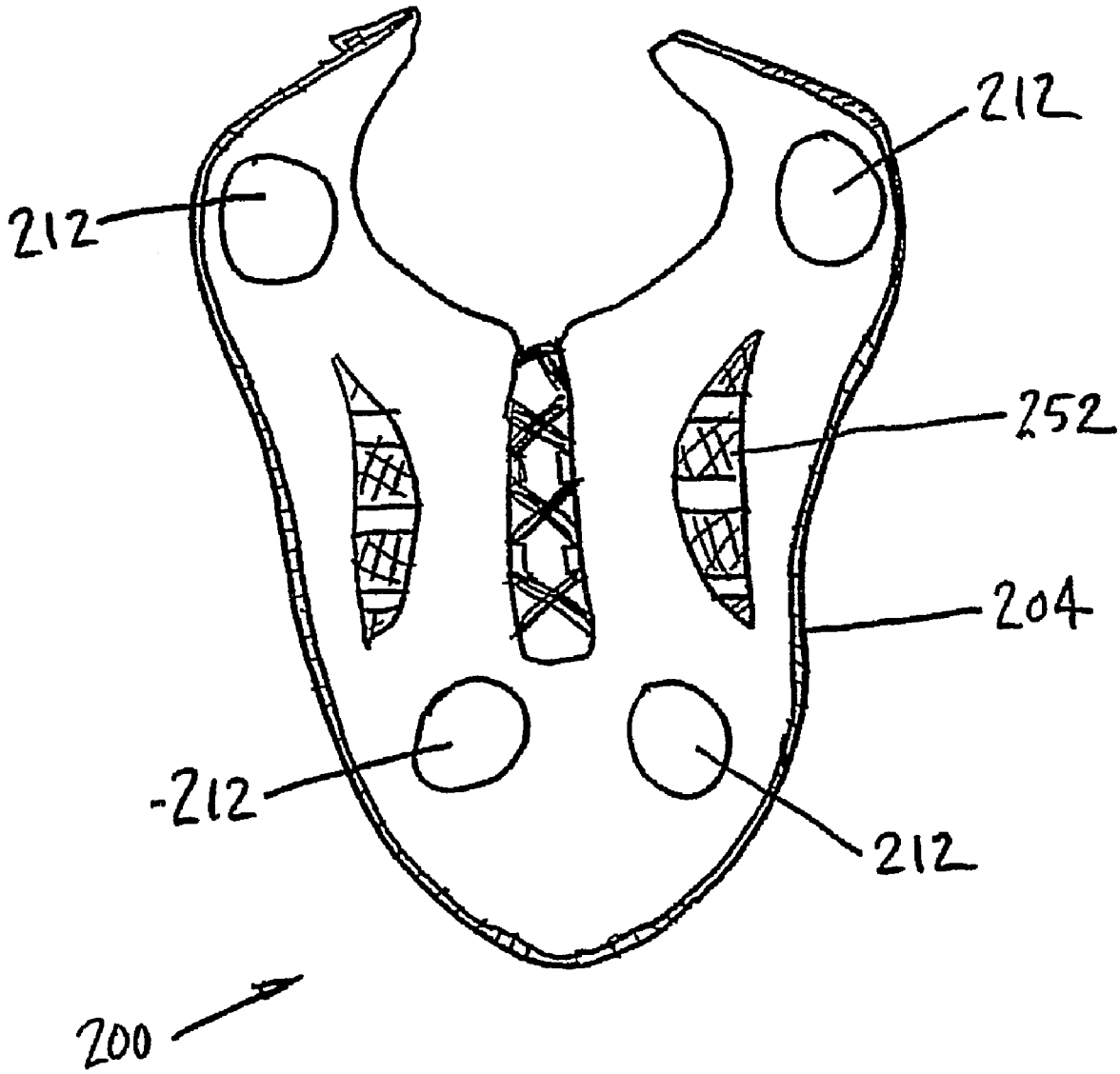
FIG. 9 depicts a bottom view of an interchangeable upper in accordance with an exemplary embodiment.
Figure 10:
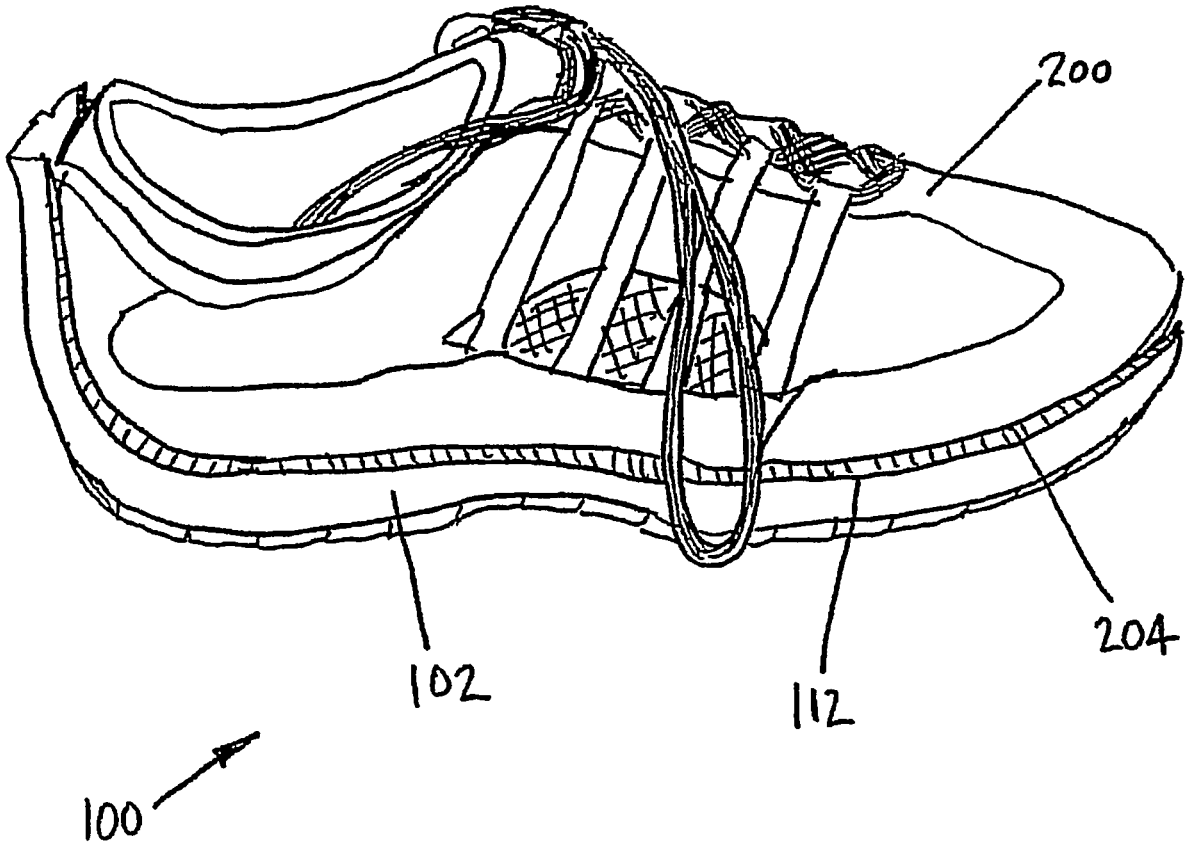
FIG. 10 depicts a side view of an article of footwear with the interchangeable upper attached, in accordance with an exemplary embodiment.

FIGS. 8, 9, and 10 depict another particular example of the aforementioned embodiments. FIG. 8 depicts an article of footwear 100 including a sole 102 fixedly connected to a fixed upper 104. As discussed above, the fixed upper 104 can be a bootie type of inner sock, rigid enough to hold the sole 102 and fixed upper 104 on a wearer's foot. The fixed upper can also have some elasticity and can allow a user to slip his or her foot into the article of footwear through the fixed upper 104, which can make it easier to for a user to attach or unattach an interchangeable upper 200 (shown in FIG. 9) from the article of footwear 100. The fixed upper can also include a breathable material 250, such as mesh. The mesh or other breathable material can allow air flow to a user's foot, allowing the foot to avoid overheating due to multiple layers of uppers (such as the fixed upper 104 and an interchangeable upper (shown in FIG. 9), for example).

FIG. 8 also depicts multiple alignment means 114 on the exterior of the fixed upper 104. In this particular example, the alignment means 114 are in four locations: one on each side of the front of the article of footwear 100 (although only one is visible in this view), near a wearer's toes, and one on each side of the back of the article of footwear 100, near a wearer's heel. In this embodiment, the alignment means 114 are pieces of hook and loop fasteners, such as Velcro™ fasteners, wherein the four alignment means 114 on the fixed upper 104 correspond to four alignment means on the inside surface of the interchangeable upper 200 (shown in FIG. 9). Other configurations and examples are of course possible.

FIG. 8 also depicts a releasable fastener 112 around the sole 102. In this particular example, the releasable fastener 112 is a zipper. As shown in FIG. 8, the sole 102 of the article of footwear 100 can include one edge of the zipper, and the interchangeable upper 200 (shown in FIG. 9) can include the other edge of the zipper. The zipper can extend from one side of the heel of the article of footwear 100 around the toe portion to the other side of the heel. Other configurations and examples of releasable fasteners are possible as well.

FIG. 9 depicts a bottom view of an interchangeable upper 200. The interchangeable upper 200 comprises multiple alignment means 212, which can correspond to the alignment means 114 of the fixed upper 104. The interchangeable upper 200 also comprises a releasable fastener 204, which in this particular example is a zipper. As shown in FIG. 9, the outside edge of the interchangeable upper 200 can include one edge of the zipper, and the sole 102 (shown in FIG. 8) can include the other edge of the zipper. As also depicted in FIG. 9, the interchangeable upper 200 can also include a breathable material 252, such as mesh. The breathable material 252 of the interchangeable upper 200 can correspond with the breathable material 250 of the fixed upper 104 and, as discussed above, can allow airflow to the wearer's foot.

As shown in the example of FIG. 9, the interchangeable upper 200 is open at the heel portion. A user can therefore wrap the interchangeable upper 200 around the fixed upper 104 (as opposed to the user having to slip his or her foot into the interchangeable upper 200 like a shoe). The four alignment means 212 on the interchangeable upper 200 can then be aligned with the four corresponding alignment means 114 on the fixed upper 104, and the interchangeable upper 200 can then be firmly held in the proper location for fastening to the article of footwear 100. To fasten the interchangeable upper 200 to the article of footwear 100, a user can engage the zipper on one side of the heel and zip around the circumference of the sole 102 to the other side of the heel. The alignment means 114 and 212 can facilitate this zipping by, for instance, holding the interchangeable upper 200 in place, possibly freeing up one of the user's hands to help zip the zipper, and by removing any guesswork involved in identifying the proper placement of the interchangeable upper 200 in relation to the fixed upper 104.

FIG. 10 depicts the interchangeable upper 200 fastened to the article of footwear 100. Once the interchangeable upper

200 is fastened to the article of footwear 100, a user can take the article of footwear 100 off or put it on as with any article of footwear. If the article of footwear 100 has shoe laces, as in the example of FIG. 10, the user can tie and untie the shoe laces as with any article of footwear with laces. To remove the interchangeable upper 200 from the article of footwear 100, a user can simply release the releasable fastener 112 and 204 (in this example, the user can unzip the zipper), disengage the alignment means 114 and 212, and pull the interchangeable upper 200 away from the sole 102 and the fixed upper 104 of the article of footwear 100. The user can then attach another interchangeable upper 200 to the article of footwear 100.

It should be understood, however, that all the arrangements described herein are set forth for purposes of example only. As such, those skilled in the art will appreciate that other arrangements and other elements (e.g., components of the article of footwear, etc.) can be used instead, particular components shown in one embodiment can be used with the components and elements shown in other embodiments, and some elements may be omitted altogether. Further, those skilled in the art will appreciate that although the concepts herein are expressed in relation to an article of footwear or components of an article of footwear, these concepts can also be applied to other products, including articles of clothing, clothing accessories, etc.

2. Conclusion

Several exemplary embodiments of the present invention have been described above. Those skilled in the art will understand, however, that changes and modifications may be made to these embodiments without departing from the true scope and spirit of the present invention, which is defined by the claims.

I claim:

1. A footwear component of an article of footwear, the footwear component comprising:

an interchangeable upper portion including a rear portion, the interchangeable upper portion defining an outer perimeter and being open at the rear portion;

one or more releasable fasteners disposed along at least a portion of the outer perimeter of the interchangeable upper portion and adapted for releasably fastening the interchangeable upper portion to an article of footwear; and one or more alignment mechanisms disposed on the rear portion of the interchangeable upper portion away from the outer perimeter of the interchangeable upper portion for aligning the interchangeable upper portion on an article of footwear prior to releasably fastening the interchangeable upper portion to an article of footwear.

2. The footwear component of claim 1, wherein the one or more alignment mechanisms include hook and loop fasteners.

3. The footwear component of claim 1, further comprising shoelaces.

4. The footwear component of claim 1, wherein at least a portion of the interchangeable upper portion comprises a breathable material.

5. The footwear component of of claim 1, wherein at least a portion of the interchangeable upper portion comprises a portion of breathable material, and wherein the portion of breathable material on the interchangeable upper portion can correspond with a portion of breathable material on a fixed upper portion of an article of footwear, and thereby can allow airflow through the breathable portions to a wearer's foot.

6. The combination of the footwear component of claim 1 and an article of footwear, wherein the interchangeable upper portion is releasably fastened to the article of footwear.

7. The combination of claim 6, wherein the article of footwear comprises:

a fixed upper portion;

a sole fixedly connected to the fixed upper portion; and one or more releasable fasteners for engaging the one or more releasable fasteners on the interchangeable upper portion and for releasably fastening the interchangeable upper portion to the article of footwear.

8. The footwear component of claim 7, wherein the fixed upper portion further comprises one or more alignment mechanisms for receiving the one or more alignment mechanisms of the interchangeable upper portion.

9. The footwear component of claim 8, wherein the one or more alignment mechanisms of the interchangeable upper portion are engaging the one or more alignment mechanisms of the interchangeable upper portion.

10. The footwear component of claim 7, wherein the interchangeable upper portion substantially covers the fixed upper portion.

11. The footwear component of claim 1, wherein the interchangeable upper portion is large enough to substantially cover a fixed upper portion of an article of footwear when releasably fastened thereto.

12. An article of footwear comprising:

a fixed upper portion defining a bottom exterior perimeter;

a sole defining an outer exterior perimeter, the sole fixedly connected to the fixed upper portion such that the outer exterior perimeter of the sole generally corresponds with a substantial portion of the bottom exterior perimeter of the fixed upper portion to form an outer perimeter of the article of footwear;

one or more releasable fasteners for releasably fastening an interchangeable upper portion to the article of footwear, the one or more releasable fasteners being generally disposed along at least a portion of the outer perimeter of the article of footwear but not extending continuously along the entire outer exterior perimeter of the sole; and one or more alignment mechanisms for aligning the interchangeable upper portion with the fixed upper portion prior to releasably fastening the interchangeable upper portion to the article of footwear, the one or more alignment mechanisms being disposed on a rear portion of the fixed upper portion away from the outer perimeter of the article of footwear.

13. The article of footwear of claim 12, wherein the one or more alignment mechanisms include hook and loop fasteners.

14. The article of footwear of claim 12, further comprising an interchangeable upper portion, the interchangeable upper portion comprising:

one or more releasable fasteners for releasably fastening the interchangeable upper portion to the article of footwear.

15. The article of footwear of claim 14, wherein the interchangeable upper portion further comprises one or more alignment mechanisms for aligning the interchangeable upper portion on the article of footwear prior to releasably fastening the interchangeable upper portion to the article of footwear.

16. The article of footwear of claim 15, wherein the one or more alignment mechanisms of the interchangeable upper portion are engaging the one or more alignment mechanisms of the article of footwear.

17. The article of footwear of claim 14, wherein the interchangeable upper portion is releasably fastened to the article of footwear.

18. The article of footwear of claim 12, wherein at least a portion of the fixed upper portion comprises a breathable material.

19. The article of footwear of claim 12, wherein at least a portion of the fixed upper portion comprises a breathable material, and wherein the portion of breathable material on the fixed upper portion can correspond with a portion of breathable material on an interchangeable upper portion, and thereby can allow airflow through the breathable portions to a wearer's foot.

20. The article of footwear of claim 12, further comprising an interchangeable upper portion releasably fastened to the article of footwear.

21. The article of footwear of claim 20, wherein the interchangeable upper portion substantially covers the fixed upper portion.

22. An article of footwear comprising:

a fixed upper portion defining a bottom exterior perimeter;

a sole defining an outer exterior perimeter, the sole fixedly connected to the fixed upper portion such that the outer exterior perimeter of the sole generally corresponds with a substantial portion of the bottom exterior perimeter of the fixed upper portion to form an outer perimeter of the article of footwear;

one or more releasable fasteners releasably fastening an interchangeable upper portion to the article of footwear, the one or more releasable fasteners being generally disposed along at least a portion of the outer perimeter of the article of footwear but not extending continuously along the entire outer exterior perimeter of the sole; and one or more alignment mechanisms for aligning the interchangeable upper portion with the article of footwear prior to releasably fastening the interchangeable upper portion to the article of footwear, the one or more alignment mechanisms disposed on a rear portion of the article of footwear away from the outer perimeter of the article of footwear.

23. The article of footwear of claim 22, wherein one or more of the one or more alignment mechanisms is disposed on the fixed upper portion and a corresponding one or more of the one or more alignment mechanisms is disposed on the interchangeable upper portion.

24. The article of footwear of claim 23, wherein the one or more alignment mechanisms of the fixed upper portion are engaging the one or more alignment mechanisms of the interchangeable upper portion.

25. The article of footwear of claim 22, wherein the interchangeable upper portion substantially covers the fixed upper portion.

26. A method of releasably fastening an interchangeable upper portion of an article of footwear to a fixed upper portion of an article of footwear, the article of footwear defining an outer exterior perimeter, the method comprising:

engaging one or more alignment mechanisms on the interchangeable upper portion with one or more alignment mechanisms on the article of footwear, the one or more alignment mechanisms on the interchangeable upper portion being disposed on a rear portion of the interchangeable upper portion away from the exterior perimeter, and the one or more alignment mechanisms on the article of footwear being disposed on a rear portion of the article of footwear away from the outer exterior perimeter; and releasably fastening the interchangeable upper portion to the fixed upper portion along at least a portion of the outer exterior perimeter but not continuously along the entire outer exterior perimeter.

27. The article of footwear of claim 22, wherein the one or more releasable fasteners comprise zippers.

28. The article of footwear of claim 22, wherein a portion of at least one of the one or more releasable fasteners disposed along at least a portion of the outer perimeter of the article of footwear extends away from the sole at a heel portion of the article of footwear.

29. The article of footwear of claim 12, wherein the interchangeable upper portion is large enough to substantially cover a fixed upper portion of an article of footwear when releasably fastened thereto.

* * * * *